US005529209A

United States Patent [19]

Herzog

[11] Patent Number: 5,529,209

[45] Date of Patent: Jun. 25, 1996

[54] EASY LOAD ELEVATING HOPPER

[76] Inventor: Kenneth J. Herzog, 200 Mill Rd., Riverhead, N.Y. 11901

[21] Appl. No.: 281,587

[22] Filed: Jul. 28, 1994

[51] Int. Cl.[6] ..... G07F 11/48

[52] U.S. Cl. ..... 221/188; 221/288

[58] Field of Search ..... 221/186, 188, 221/189, 190, 281, 288, 303, 312 B; 414/421, 733, 734, 743

[56] References Cited

U.S. PATENT DOCUMENTS

| | | | |
|---|---|---|---|
| 1,490,664 | 4/1924 | Eidmann | 414/743 X |
| 3,672,724 | 6/1972 | Neuzil | 414/743 X |
| 4,215,968 | 8/1980 | Rymer | 414/421 |
| 4,978,271 | 12/1990 | Seader | 414/421 X |

*Primary Examiner*—William E. Terrell
*Assistant Examiner*—Dean A. Reichard

[57] ABSTRACT

An easy load elevating hopper for a bottle capping machine having a stationary dispensing hopper is provided and contains a mechanism that includes a chain and two sprocket assembly for raising a bin from a lowered charging position, to an elevated discharging position, relative to the stationary dispensing hopper on the bottle capping machine.

3 Claims, 1 Drawing Sheet

POSITION A
POSITION B
POSITION C

EASY LOAD ELEVATING HOPPER

BACKGROUND OF THE INVENTION

The instant invention relates generally to movable auxiliary hoppers and more specifically it relates to an easy load elevating hopper, which provides a mechanism for raising a bin from a lowered charging position to an elevated discharging position.

There are available various conventional movable auxiliary hoppers which do not provide the novel improvements of the invention herein disclosed.

SUMMARY OF THE INVENTION

A primary object of the present invention is to provide an easy load elevating hopper that will overcome the shortcomings of the prior art devices.

Another object is to provide an easy load elevating hopper capable of being raised from a lowered charging position to an elevated discharging position relative to a stationary dispensing hopper on a bottle capping machine.

An additional object is to provide an easy load elevating hopper in which a bin is pivotally mounted on a platform portion of the bottle capping machine via a pair of legs extending from opposite sides of the hopper operable by a crank sprocket and chain assembly.

A further object is to provide an easy load elevating hopper that is simple and easy to use.

A still further object is to provide an easy load elevating hopper that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2, 2A, 3:
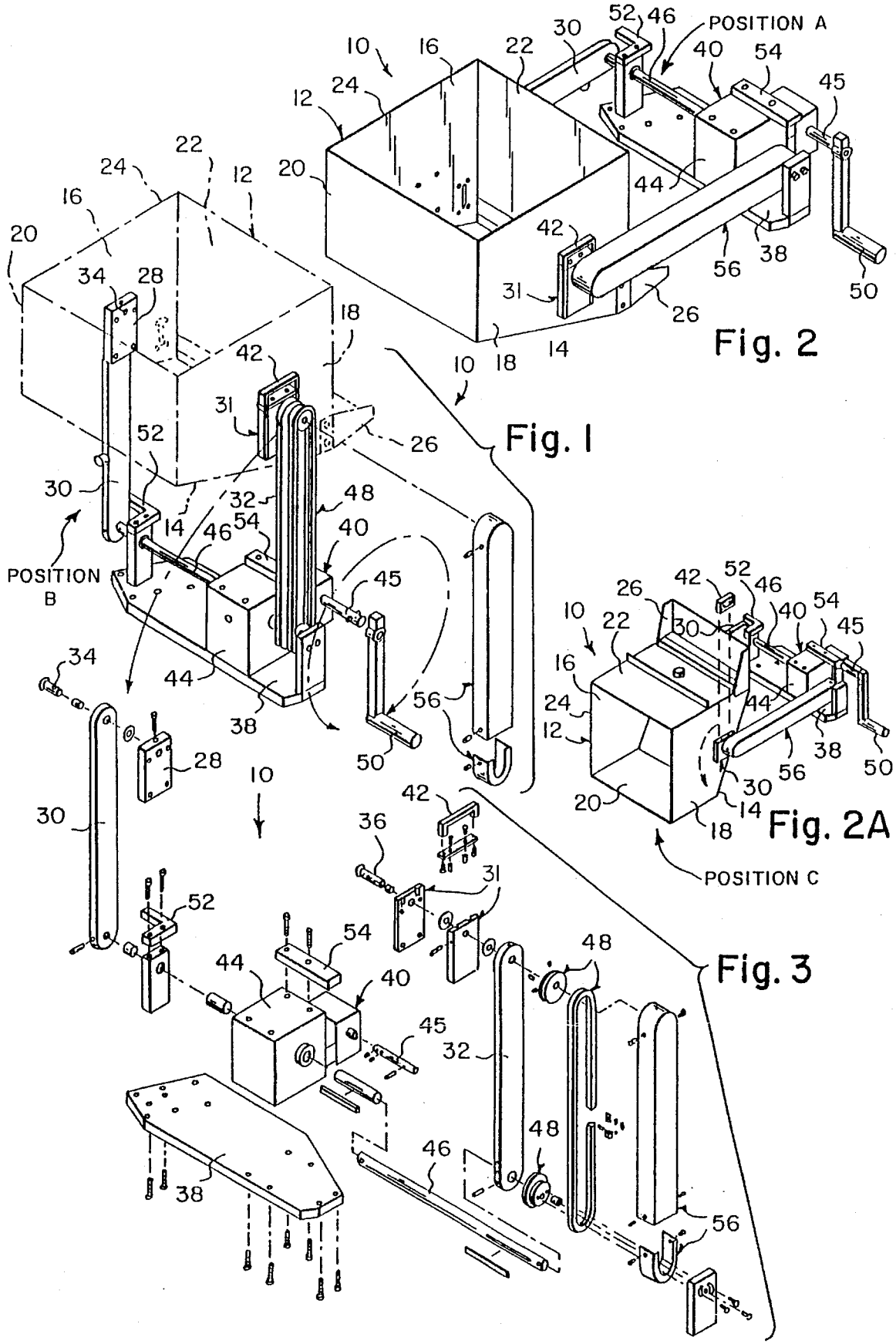
FIG. 1 is a partial exploded perspective view of the instant invention in a raised position and showing the cap bin in phantom.
FIG. 2 is a perspective view of the instant invention in a lower position.
FIG. 2A is similar to FIG. 2, showing a dump position.
FIG. 3 is an exploded perspective view of the instant invention with the cap bin removed.

Turning now descriptively to the drawings, in which similar reference characters denote similar elements throughout the several views, FIGS. 1 through 3 illustrate an easy load elevating hopper 10 for a bottle capping machine, having a stationary dispensing hopper that is shown in U.S. Pat. No. 3,905,177, which is incorporated herein by reference. The hopper 10 contains a bin 12 having a bottom wall 14, side walls 16, 18 and end walls 20, 22 and an open top 24 for receiving a charge of caps therein. The bottom wall 14 is downwardly sloped to aid in a gravity flow of the caps to a discharge end of the bin 12. A tongue 26 extends from the discharge end of the bin 12. A support pivot plate 28 is mounted on one side wall 16 of the bin 12. A locking pivot plate assembly 31 is mounted on the opposite side wall 18 of the bin 12. A pair of arms 30, 32 are provided, in which an upper end of the first arm 30 is pivotally mounted at 34 to the support pivot plate 28, while an upper end of the second arm 32 is pivotally mounted at 36 to the locking pivot plate assembly 31. A mounting plate 38 is attached to a portion of the bottle capping machine adjacent the stationary dispensing hopper, in which the arms 30, 32 extended to and are pivotally coupled on lower ends at the mounting plate 38. A structure 40 is on the mounting plate 38, for moving the bin 12 from a lowered charging position "A", as shown in FIG. 2, to an elevated discharging position "B", as shown in FIG. 1, relative to the stationary dispensing hopper on the bottle capping machine.

The locking pivot plate assembly 31 includes a locking pin handle unit 42, which can be removed from the locking pivot plate assembly 31, when the bin 12 is in the lowered charging position "A", so that the bin 12 can pivot to a dump position "C", as shown in FIG. 2A, to remove residual caps therefrom.

The moving structure 40 includes a gear box 44, mounted onto the mounting plate 38 and has a crankshaft 45 and a main support shaft 46 extending therefrom, which is pivotally coupled to the lower ends of the arms 30, 32. A chain and two sprocket assembly 48 is keyed to and extends between the main support shaft 46 on the lower end and the pivotal upper end 36 of the second arm 32. A crank handle 50 is engagable with the crankshaft 45. When the crank handle 50 is rotated in one direction, the bin 12 will go from the lowered charging position "A" to the elevated discharging position "B". When the crank handle 50 is rotated in an opposite direction, the bin 12 will go from the elevated discharging position "B" to the lowered charging position "A".

The moving structure 40 further contains a pair of stops 52, 54 mounted thereto to contact the arms 30, 32 in a vertical condition, when the bin 12 is in it's fully elevated discharging position "A". A chain guard assembly 56 is provided to cover and protect the chain and two sprocket assembly 48.

OPERATION OF THE INVENTION

To use the easy load elevating hopper 10, a person simply connects the crank handle 50 to the crankshaft 45 on the gear box 44. Depending how the crank handle 50 is rotated, the bin 12 will move between it's lowered charging position "A" and it's elevated discharging position "B" and vise versa. The crank handle 50 is removable from the crankshaft 45 when not being used for safety.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An easy load elevating hopper for a bottle capping machine having a stationary dispensing hopper which comprises:

a. a bin having a bottom wall, side walls and end walls and an open top for receiving a charge of caps therein, said bottom wall being downwardly sloped to aid in a gravity flow of the caps to a discharge end of said bin;

b. a tongue extending from the discharge end of said bin;

c. a support pivot plate mounted on one of said side walls of said bin;

d. a locking pivot plate assembly mounted on an opposite one of said side walls of said bin including a locking pin handle unit removable therefrom in a lowered charging position of said bin preparatory to a pivotal traverse of said bin into a dump position incident to removal of residual caps therefrom;

e. a pair of arms, in which an upper end of a first arm is pivotally mounted to said support pivot plate, while an upper end of a second arm is pivotally mounted to said locking pivot plate assembly;

f. a mounting plate to be attached to a portion of the bottle capping machine adjacent the stationary dispensing hopper, in which said arms extended to and are pivotally coupled on lower ends at said mounting plate; and g. means in said mounting plate for moving said bin from a lowered charging position to an elevated discharging position, relative to the stationary dispensing hopper on the bottle capping machine.

2. An easy load elevating hopper as recited in claim 1, wherein said moving means includes:

a. a gear box mounted onto said mounting plate and having a crankshaft and a main support shaft extending therefrom, said main support shaft being pivotally coupled to the lower ends of said arms;

b. a chain and two sprocket assembly keyed to and extending between said main support shaft on the lower end and the pivotal upper end of said second arm; and c. a crank handle engagable with said crankshaft, so that when said crank handle is rotated in one direction, said bin will go from the lowered charging position to the elevated discharging position and when said crank handle is rotated in an opposite direction, said bin will go from the elevated discharging position to the lowered charging position.

3. An easy load elevating hopper as recited in claim 2, wherein said moving means further includes:

a) a pair of stops mounted thereto to contact said arms in a vertical condition, when said bin is in it's fully elevated discharging position; and b) a chain guard assembly to cover and protect said chain and two sprocket assembly.

* * * * *